US008262499B2

(12) United States Patent
Murphy

(10) Patent No.: US 8,262,499 B2
(45) Date of Patent: Sep. 11, 2012

(54) GOLF CLUB WITH ADJUSTABLE HOSEL ANGLE

(75) Inventor: Steve Murphy, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 12/486,048

(22) Filed: Jun. 17, 2009

(65) Prior Publication Data

US 2010/0323809 A1 Dec. 23, 2010

(51) Int. Cl.
*A63B 53/02* (2006.01)

(52) U.S. Cl. ..... 473/309; 473/246

(58) Field of Classification Search ..... 473/288, 473/307, 309–310, 244–246, 248, 311
See application file for complete search history.

(56) References Cited

U.S. PATENT DOCUMENTS

| | | | | |
|---|---|---|---|---|
| 4,999,407 | A * | 3/1991 | Gilch et al. | 525/457 |
| 5,429,358 | A * | 7/1995 | Rigal et al. | 473/309 |
| 5,626,528 | A * | 5/1997 | Toulon | 473/248 |
| 6,260,250 | B1 | 7/2001 | Hall et al. | 29/281.1 |
| 6,726,971 | B1 * | 4/2004 | Wong | 428/40.1 |
| 6,825,315 | B2 * | 11/2004 | Aubert | 528/393 |
| 7,207,898 | B2 * | 4/2007 | Rice et al. | 473/329 |
| 2004/0214978 | A1 * | 10/2004 | Rosin et al. | 528/44 |
| 2008/0167137 | A1 | 7/2008 | Burnett et al. | |
| 2010/0041490 | A1 * | 2/2010 | Boyd et al. | 473/288 |

* cited by examiner

*Primary Examiner* — Stephen L. Blau
(74) *Attorney, Agent, or Firm* — Murphy & King, P.C.

(57) ABSTRACT

A golf club head with an adjustable hosel that sits within a cavity loaded with filler material. The cavity may generally extend from crown to sole or, in the alternative, extend only a partial amount of the distance from the crown to the sole.

18 Claims, 7 Drawing Sheets

GOLF CLUB WITH ADJUSTABLE HOSEL ANGLE

FIELD OF THE INVENTION

The present invention relates to a golf club head with an adjustable hosel. Specifically, the present invention relates to a golf club head with a cavity containing a material that allows for modifications to the hosel angle thereby allowing for variations in face angle, lie angle, and loft angle.

BACKGROUND OF THE INVENTION

Golf clubs are typically manufactured to fit an average person of average dimensions. Thus, the same club is manufactured regardless of the particular golfer's needs. This presents a problem due to the fact that not all golfers are built the same, and not all golfers have identical swings. In addition, due to manufacturing tolerances, many golf clubs that claim to be a particular lie, loft, or face angle may be off by as much as 1°. Due to the variety of golf swings, golfers, and manufacturing flaws and/or tolerances, each individual golfer may benefit from an optimization of lie angle, face angle, loft angle, or a combination of any of these.

The lie angle of any golf club is the angle formed between the center of the shaft and the ground line of the club when the club is soled in its proper playing position (address position). Therefore, a taller golfer is likely to benefit from an increase in lie angle, which would allow for the golfer to comfortably address the ball properly. In a similar fashion, a short golfer would probably benefit from a reduction in lie angle.

Face angle is the angle of the face of the club head relative to the target. If the club head is "square," the clubface will be directly facing the target on address. A "closed" face will be aligned to the left of the target (for right-handed players). If it is "open," the face will be aligned to the right of the target.

Loft angle is a measurement, in degrees, of the angle at which the face of the club lies relative to a perfectly vertical face. Using a club with a high loft angle will typically result in a golf shot with a high initial trajectory. In contrast, utilizing a club with a low loft angle will typically result in a golf shot with a low initial trajectory.

Golf club sets are typically configured with different loft angles for the club faces, different shaft or hosel angles, different club masses, and the like, in order to optimize the swing and flight path of the ball for individual golfers. However, the finite differences between clubs, e.g., the differences in loft angles between a five-iron and a six-iron may be too large for an advanced golfer who requires a club having characteristics between the two irons. Similarly, the lie angle, which must vary with the length of the club shaft and height and stance of the golf club, may produce even more limitations to the discerning golfer.

Likewise, current manufacturer tolerances for lie and loft angles on metal woods are generally ±1°. As such, a company marketing a driver that is available in both 9° and 10° lofts may potentially sell a 10° driver that is within specifications, but actually has a 9° loft and a 9° driver that is within specifications, but actually has a 10° loft.

As a result, a number of different devices have been developed for bending the hosel or shaft attachment of a golf club head to produce clubs with finely tuned characteristics suited to the individual using those clubs. These devices generally include some form of a vise or clamp and may include a bending tool and/or gauge to measure the angle or bend in at least one axis or plane.

U.S. Pat. No. 6,260,250 generally discloses a bending plate to be used in conjunction with a conventional clamping apparatus in order to apply force to the hosel region of the club head in order to vary the lie and/or loft angle of the golf club head. As discussed in U.S. Pat. No. 6,260,250, the force to the hosel is applied using a tool well known in the golf club manufacturing industry.

Manufacturers have also attempted to create a set of hosels for a golf club that can be used interchangeably and removably to affect the lie angle, face angle, and cosmetic look of the golf club. For example, U.S. Patent Publication No. 2008/0167137, a plurality of hosels, each having about the same weight but different length and construction, may change the launch conditions of the golf club. However, as discussed in U.S. Patent Publication No. 2008/0167137, such a design requires proper attachment of the hosel in the cavity, which may require considerable torque to install and remove.

Thus, because an individual golfer is not likely to make such adjustments to a club head on his/her own without special tools or without damaging the club head, the benefits to such adjustability is significantly limited.

Therefore, there remains a need in the art for a golf club that can be easily adjusted to tighter tolerances. In addition, there remains a need for aftermarket modifications to club heads to allow adjustability with respect to parameters that ultimately affect club and ball performance. In particular, it would be advantageous to have a golf club design that allows adjustability to parameters such as lie angle, loft angle, face angle, and combinations thereof. The present invention contemplates such a golf club, a method of making such a golf club, and methods for use.

SUMMARY OF THE INVENTION

The present invention is directed to a golf club with an adjustable hosel. In particular, the present invention is directed to a golf club head comprising a body comprising a face, a crown, a sole, a toe, a heel, a cavity, a hosel, and a shaft.

The cavity comprises an outer shell and a filler material. The cavity may extend from the crown to the sole. In another embodiment, the cavity extends less than 75 percent of the distance from the crown to the sole. In one embodiment, the cavity contains at least one locking mechanism to prevent twisting of the hosel. The locking mechanism may be in the form of one or more paddles located on the hosel that correspond to one or more receptacles located in the cavity.

The filler material has a glass transition temperature, and the hosel is adjustable within the cavity when the filler material reaches the glass transition temperature. The filler material may be a thermoplastic material. In addition, the filler material may be comprised of polyurethane, polyurea, epoxy, elastomer, polyethylene, polyamides, ionomer, polyesters, polypropylene, or combinations thereof. In one embodiment, the filler material is selected from the group consisting of polyurethane, polyurea, or a combination thereof. The glass transition temperature of the filler material may be about 130° F. or higher. In one embodiment the glass transition temperature is about 140° F. or higher.

Various characteristics of the golf club head are adjustable when the filler material is heated to or above the glass transition temperature. For example, the face angle, lie angle, and/or loft angle of the club head may be adjusted. In one embodiment, the golf club head has a face angle that is adjustable by about 10° or less from a square alignment. In another embodiment, the golf club head has a lie angle that is adjustable by about 20°. In another embodiment, the golf club head has a loft angle that is adjustable by about 5° or less from the preset loft angle.

The present invention is also directed to a method of adjusting a golf club head. The method includes providing a golf club head comprising a body, a face, a crown, a sole, a toe, a heel, a cavity, a hosel, and a shaft, wherein the cavity comprises an outer shell.

The cavity is filled with a thermoplastic material having a glass transition temperature. The thermoplastic material comprises polyurethane, polyurea, epoxy, elastomer, polyethylene, polyamides, ionomer, polyesters, polypropylene, or combinations thereof.

The thermoplastic material is heated to the glass transition temperature, which allows for the adjustment of the hosel. In one embodiment, the step of heating the thermoplastic material comprises heating the golf club head to a temperature of about 130° F. or greater. In another embodiment, the step of heating the thermoplastic material comprises heating the golf club head to a temperature of about 140° F. or greater.

The hosel is then adjusted to a desired location changing at least one of face angle, lie angle, or loft angle. For example, the face angle of the golf club head may be adjusted by about 10° or less from a square alignment. In one embodiment, the step of adjusting the hosel results in adjusting a lie angle of the golf club head between about 40° to about 70°. In another embodiment, the step of adjusting the hosel results in adjusting a loft angle of the golf club head by about 5° or less from the preset loft angle. Finally, the thermoplastic material is allowed to solidify, securing the hosel within the cavity.

BRIEF DESCRIPTION OF THE DRAWINGS

Further features and advantages of the invention can be ascertained from the following detailed description that is provided in connection with the drawing(s) described below.

DETAILED DESCRIPTION OF THE EMBODIMENTS OF THE INVENTION

The present invention is a golf club head that allows for the manipulation of the hosel angle in relation to the golf club head. These alterations result in a plurality of possible lie angles, loft angles, and face angles, and combinations thereof thus facilitating fine tuning of golf clubs.

Briefly, the club heads of the present invention have a hosel that sits within a cavity filled with material that is a solid at normal golfing conditions, but can be rendered viscous at certain conditions. When the filler material is solid, the hosel is held in place securely and the club head acts as one rigid body. When the filler material is in a viscous state, the hosel position may be adjusted. For example, once heated to the appropriate temperature, the filler material changes from a solid into a viscous liquid state allowing the hosel to be manipulated, thus, in turn allowing for the adjustment of the lie angle, face angle, loft angle or any combination thereof. Upon reaching the desired adjustability, the filler material is allowed to cool and solidify, which then retains the hosel and, thus, the shaft in the desired location. The club heads of the invention are contemplated for wood-type golf clubs, iron-type golf clubs, putter-type golf clubs, and sets including combinations thereof.

Figure 1:
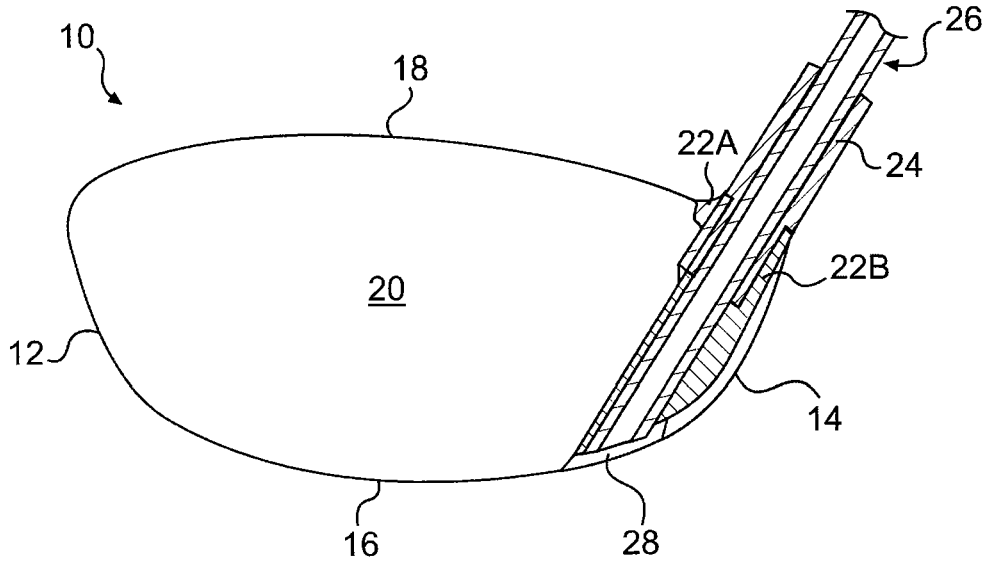
FIGS. 1-2 are partial cut away front views of golf club heads according to the present invention.
Figure 2:
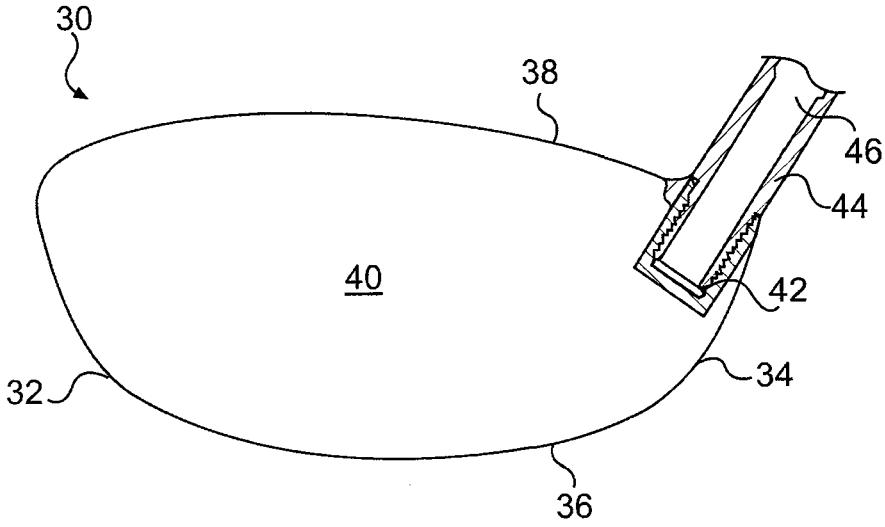

FIGS. 1-2 show golf club heads of the present invention. For example, FIG. 1 shows a golf club head 10 with a toe 12, heel 14 opposite toe 12, sole 16, crown 18 opposite sole 16, and a club face 20 for impacting golf balls. The golf club head 10 also includes cavities 22*a* and 22*b* on both sides of a hosel 24 disposed adjacent heel 14 and running generally from crown 18 to sole 16. The cavities 22*a* and 22*b* are formed of a hard, durable material, the thickness of which is sufficient to provide support to the cavities 22*a* and 22*b* themselves and hold a filler material that is hard and durable under normal conditions, but viscous under certain other conditions.

The hosel 24 is disposed within the cavities 22*a* and 22*b* and is preferably a hollow tube or cylinder to accommodate insertion and attachment of shaft 26. Because the cavities contain filler material, the hosel 24 is secured by the filler material 130 at normal conditions, but adjustably positioned under certain other conditions dependent on the type of material used as the filler material.

As shown in FIG. 1, cavities 22*a* and 22*b* may generally extend from the crown 18 to the sole 16 of golf club head 10. The bottom of the cavities may be reinforced at the sole with a small ring 28 or other cap formed of a material that remains hard and durable at the conditions with which the filler material is made viscous.

Alternatively, the cavity surrounding the hosel may extend less the entire length from the crown to the sole. For example, in one embodiment, the cavity extends less than about 90 percent of the distance between the crown 18 and the sole 16. In one embodiment, cavity 42 extends at least about 10 percent of the distance from crown 38 to sole 36. In another embodiment, cavity 42 extends between about 15 percent and about 75 percent of the distance from crown 38 to sole 36. In yet another embodiment, cavity 42 extends between about 25 percent and about 60 percent from crown 38 to sole 36.

For example, as shown in FIG. 2, golf club head 30 has a toe 32, heel 34 opposite toe 32, sole 36, crown 38 opposite sole 36, and a club face 40 for impacting golf balls. The golf club head 30 also includes a cavity 42 disposed adjacent heel 34 and extending only a portion of the length from the crown 38 to the sole 36. The cavity includes a filler material that secures the hosel 44 that is disposed within the cavity 42. Shaft 46 fits within the hosel 44. As seen in FIG. 2, the cavity only extends about halfway to the sole 36.

Figure 3:
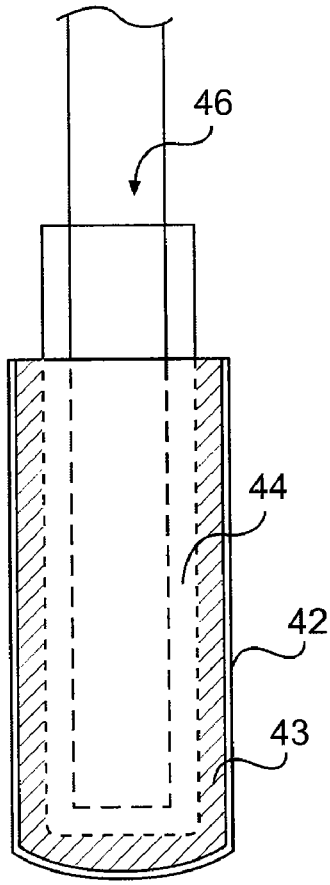
FIG. 3 is a partial cut away view of the adjustable hosel and cavity according to an embodiment of the present invention.

As discussed, the hosel may be secured within dual cavities situated on both sides of hosel (FIG. 1) or a single cavity (FIG. 2). In either case, the dual cavities 22*a* and 22*b* and cavity 42 may be rounded at the bottom or squared off. For example, as shown in FIG. 3, the hosel 44 may sit within a rounded cavity 42 loaded with filler material 43. The rounded nature of the cavity 42 at the bottom of the cavity may enable greater adjustability of the hosel 44 similar to a ball and socket design.

Locking Mechanisms

In order to prevent the twisting of the hosel in the cavity, one or more locking mechanisms may be employed.

Figures 4A, 4B, 4C:
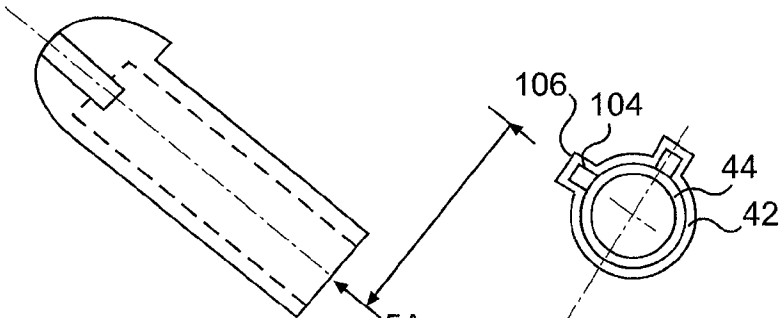
FIG. 4*a* is a view of the shaft axis of a locking mechanism of the present invention.
FIG. 4*b* is a side view of a locking mechanism of the present invention.
FIG. 4*c* is a front view of a golf club head showing the shaft axis.
Figure 5A:
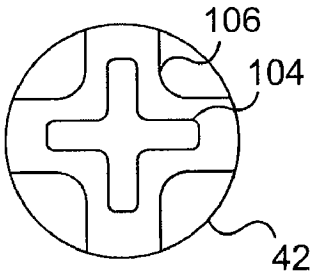
FIG. 5*a* is a view along the line 3-3 of FIG. 5*b* showing a locking mechanism located on the bottom of a cavity of the present invention.
Figure 5B:
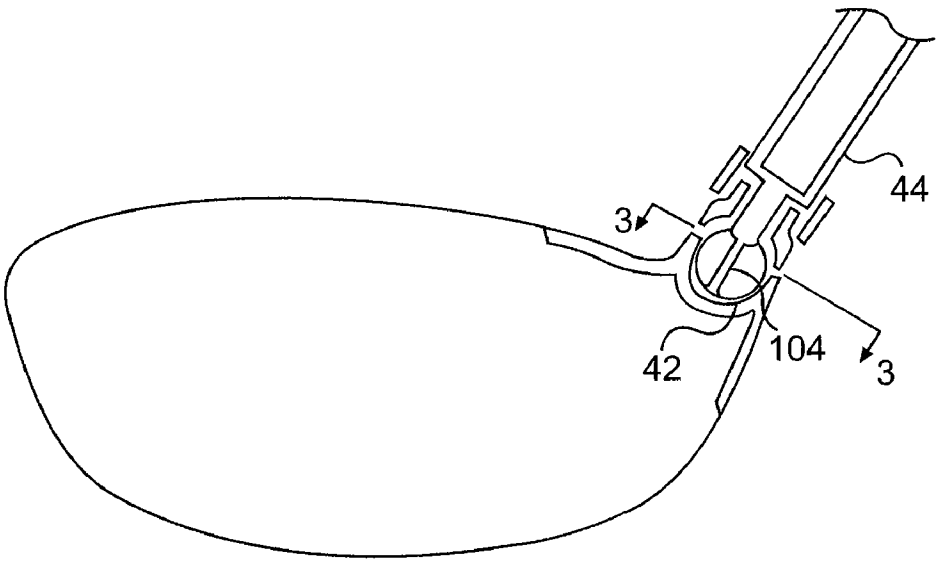
FIG. 5*b* is a front view of a golf club head showing a locking mechanism according to the present invention.

In one embodiment, the end of hosel 44 may be shaped with one or more paddles 104 as depicted in FIGS. 4*a-c*. In addition, the bottom of cavity 42 may be shaped with one or more receptacles 106 to accommodate the paddle 104 on the bottom of hosel 44. The paddle shape and corresponding receptacle on the cavity effectively limit the amount of twisting of the hosel that may occur. An alternative arrangement is displayed in FIGS. 5*a* and 5*b*. In this embodiment, the bottom of hosel 44 has a four-prong paddle 104 that is sized to fit within similarly shaped receptacle 106.

Figure 6:
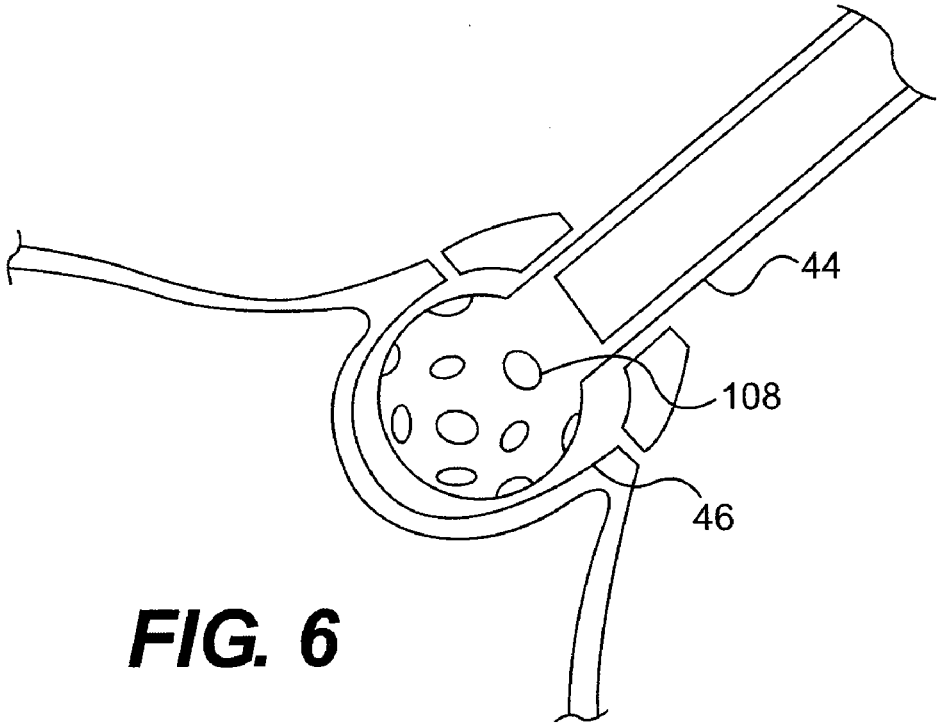
FIG. 6 is a partial cut away front view of a golf club head showing a locking mechanism according to the present invention.

FIG. 6 shows another embodiment where hosel 44 is designed with indentations or holes 108. Upon solidification of filler material the holes or indentations in hosel 44 are filled with the filler material, which further prevents twisting or rotation in cavity 42.

Figure 7:
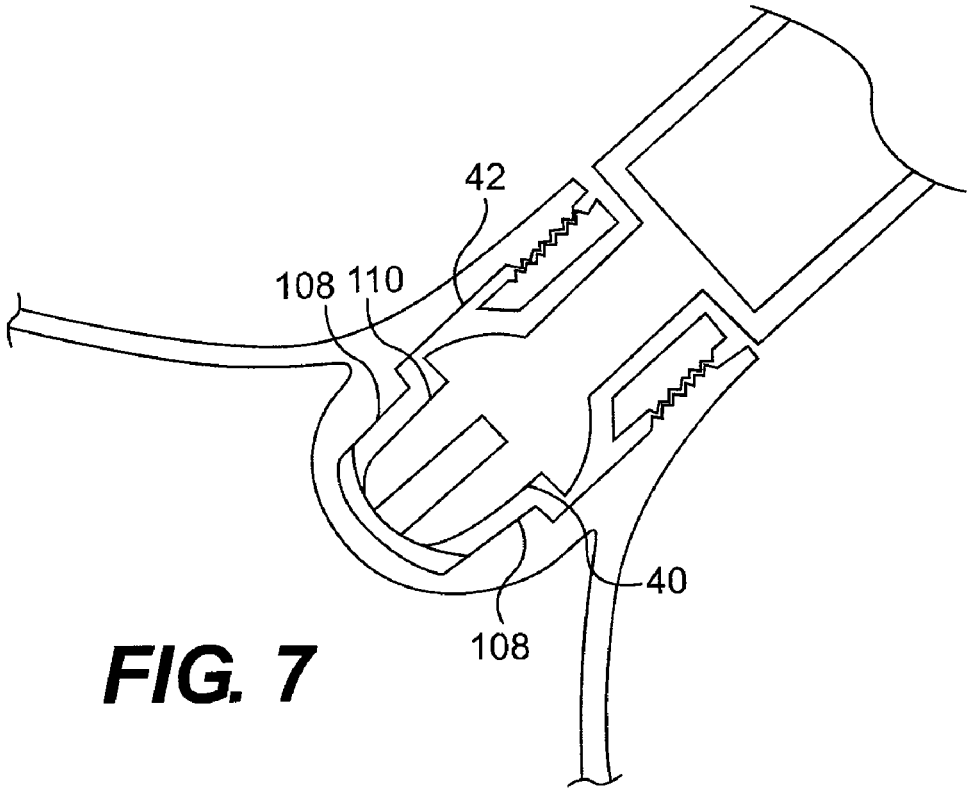
FIG. 7 is a partial cut away front view of a golf club head showing a locking mechanism according to the present invention.

As shown in FIG. 7, hosel 44 may be equipped with one or more grooves 110 that correspond to one or more notches 108 formed on the interior surface of cavity 42. Notches 108 are sized fit within the grooves in cavity 42, which reduces twisting or rotation of the hosel 44.

As would be appreciated by a skilled artisan, any combination of the locking mechanisms described may be employed. For example, the hosel may have both grooves and indentations, and the cavity may have notches that correspond with the grooves.

Hosel Adjustability

A plurality of hosel orientations is possible with the use of a filler material that is hard and durable under normal play conditions, but malleable under certain conditions outside of normal play conditions. This allows the manufacturer, user, or the like to adjust the lie angle, face angle, loft angle, or combinations thereof to achieve a desired level of control.

Lie Angle

Figure 8:
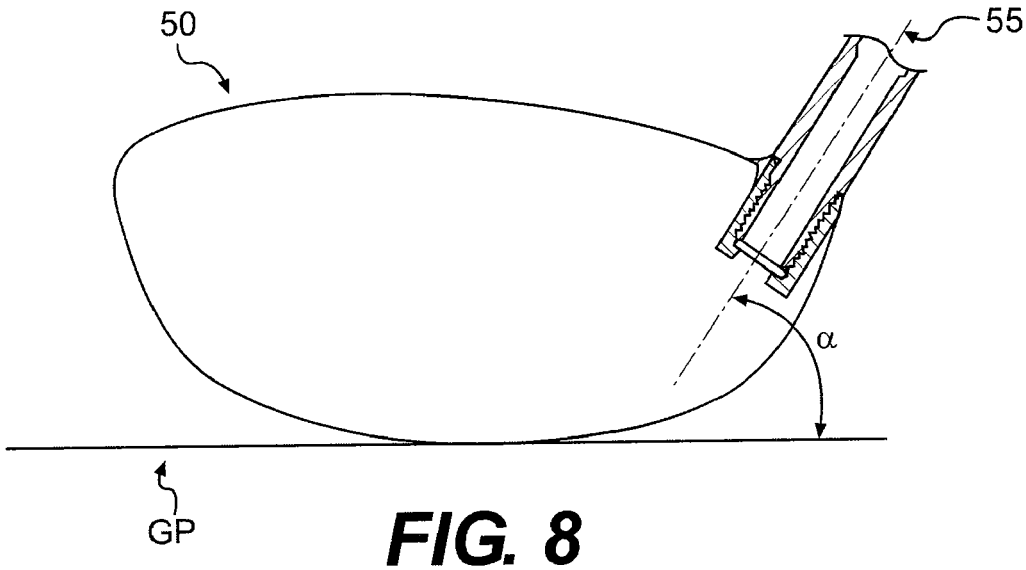
FIG. 8 is a partial cut away front view of a golf club head showing the adjustability of the lie angle according to the present invention.

FIG. 8 is a front view of a metalwood club head 50 of the present invention. When the club is in address position, shaft axis 55 intersects ground plane GP at an angle $\alpha$, otherwise known as the lie angle. Because the lie angle is typically predetermined by the manufacturer and designed to fit an average golfer, the lie angle for a tall golfer and the lie angle for a short golfer can vary significantly. For example, a short golfer would require a smaller lie angle than a tall golfer in order to obtain the full benefits of the club head design.

Standard lie angles suitable for most golfers, as determined by golf club manufacturers are provided in Table 1 below:

| Club | Lie Angle |
|---|---|
| Driver | 50 |
| 2 Wood | 55.5 |
| 3 Wood | 56 |

-continued

| Club | Lie Angle |
|---|---|
| 4 Wood | 56.5 |
| 5 Wood | 57 |
| 6 Wood | 57.5 |
| 7 Wood | 58 |
| 1 Iron | 56 |
| 2 Iron | 57 |
| 3 Iron | 58 |
| 4 Iron | 59 |
| 5 Iron | 60 |
| 6 Iron | 61 |
| 7 Iron | 62 |
| 8 Iron | 62.5 |
| 9 Iron | 63 |
| Pitching Wedge | 63.5 |
| Gap Wedge | 64 |
| Sand Wedge | 64 |
| Lob Wedge | 64 |

In this aspect of the invention, the hosel in a golf club of the invention is preferably fine tuned to a degree such that the lie angle of any particular golf club is adjustable between about 40° and about 70°.

In one embodiment, the lie angle of a driver may be adjusted between about 40° about 60°. In other words, the lie angle of a driver according to the present invention may be adjusted by about 20 percent in either direction. In one embodiment, the lie angle is adjustable by about 5 percent or more.

The lie angle of a wood-type club head is preferably adjustable between about 45° to about 70°, more preferably between about 50° to about 70°. Likewise, the lie angle of a long iron may be adjusted between about 50° to about 65° and the lie angle of a short iron may be adjusted between about 55° to about 70°. The lie angles of wedges according to the invention are preferably adjustable between about 60° and about 70°.

However, those of ordinary skill in the art will appreciate that smaller adjustments to lie angle will be sufficient to compensate for variations in golfer height and wrist to floor measurement. For example, lie angles varying by about 3° upright or flat from the manufacturer's standard lie angles will most likely be adequate adjustment to please most golfers. Thus, in one embodiment, the hosel may be adjusted such that the lie angle is variable by about ±5° from the standard lie angle of the club. In another embodiment, the hosel may be adjusted such that the lie angle is variable by about ±4° from the standard lie angle of the club. In yet another embodiment, the lie angle is adjustable by about ±3°.

Face Angle

As discussed previously, the face angle describes the angle of the face of the club head relative to the target. Thus, adjustability of the face angle is another benefit of the golf club head of the invention.

In particular, since the hosel is adjustable within the cavity, the face angle may also be adjustable by about 10° or less from the "square" alignment, thus allowing for a wider range of face orientations including both the "open" face orientation and the "closed" face alignment. In one embodiment, the face angle $\phi$ is adjustable by at least about 5° from the "square" alignment. In another embodiment, the face angle is adjustable by at least about 7° from the "square" alignment. In still another embodiment, the face angle is adjustable by at least about 8° from the "square" alignment. In yet another embodiment, the face angle is adjustable by about 5° to about 10°, about 6° to about 9°, about 7° to about 8°, or any range therebetween.

Figure 9:
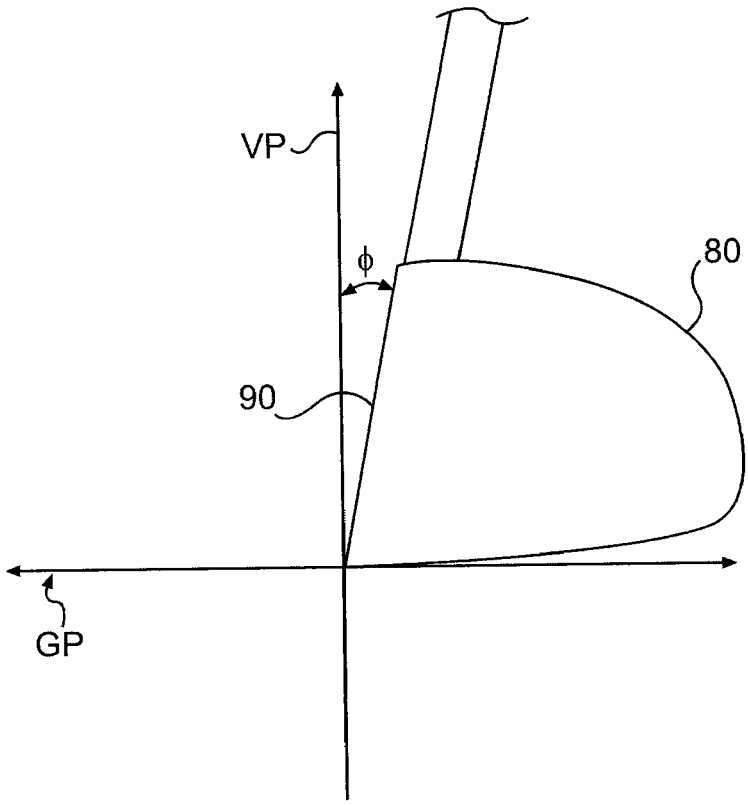
FIG. 9 is top view of a golf club head showing the adjustability of the face angle according to the present invention.

To further illustrate the adjustability of the face angle of a club head of the invention, FIG. 9 provides a golf club head of the present invention. In particular, club 60*a* illustrates a "square" alignment in which the face 62*a* of a golf club head is perpendicular with target line 70, and angle $\phi_a$ is approximately 90°. Club 60*b* shows a golf club head with an "open" alignment. For a right-handed golfer an open alignment results in an angle $\phi_b$ that is greater than approximately 90°. By utilizing the open alignment of the golf club, a golfer who tends to hook the ball may be able to achieve a shot that results in a landing that is closer to target line 70. In contrast, club 60*c* illustrates a "closed" alignment of a golf club head. In the closed alignment, angle $\phi_c$ is less than approximately 90°. This alignment is beneficial to a golfer who tends to slice the ball as the initial trajectory will be to the left of target line 80, and may result in the ball landing closer to target line 70. Thus, $\phi_b>\phi_a>\phi_c$. In this aspect of the invention, $\phi$ is adjustable in either direction toward an "open" or "closed" alignment by about 10° or less.

Loft Angle

Because the typical loft angle manufacturing tolerance is about ±1°, a golfer may end up playing with a golf club having a lower than desired loft angle, which, in turn, may result in greater distance due to the lower trajectory. Similarly, due to the loft angle manufacturing tolerance, a golfer may find that a certain club has shorter overall distance due to high trajectory driven by a higher than desired loft angle. Thus, even minor adjustments to the loft angle of a club head may provide large benefits for the advanced golfer.

In this aspect of the invention, the club heads of the present invention are preferably adjustable via the hosel such that the loft angle may vary as much as about 10° from the preset loft angle. In one embodiment, the loft angle may vary by about 5° or less. For example, a club head of the invention may have a loft angle that is adjustable by about 0.5° to about 5° from the preset loft angle. In another embodiment, the loft angle is adjustable by at least about 3° from the preset loft angle.

Figure 10:
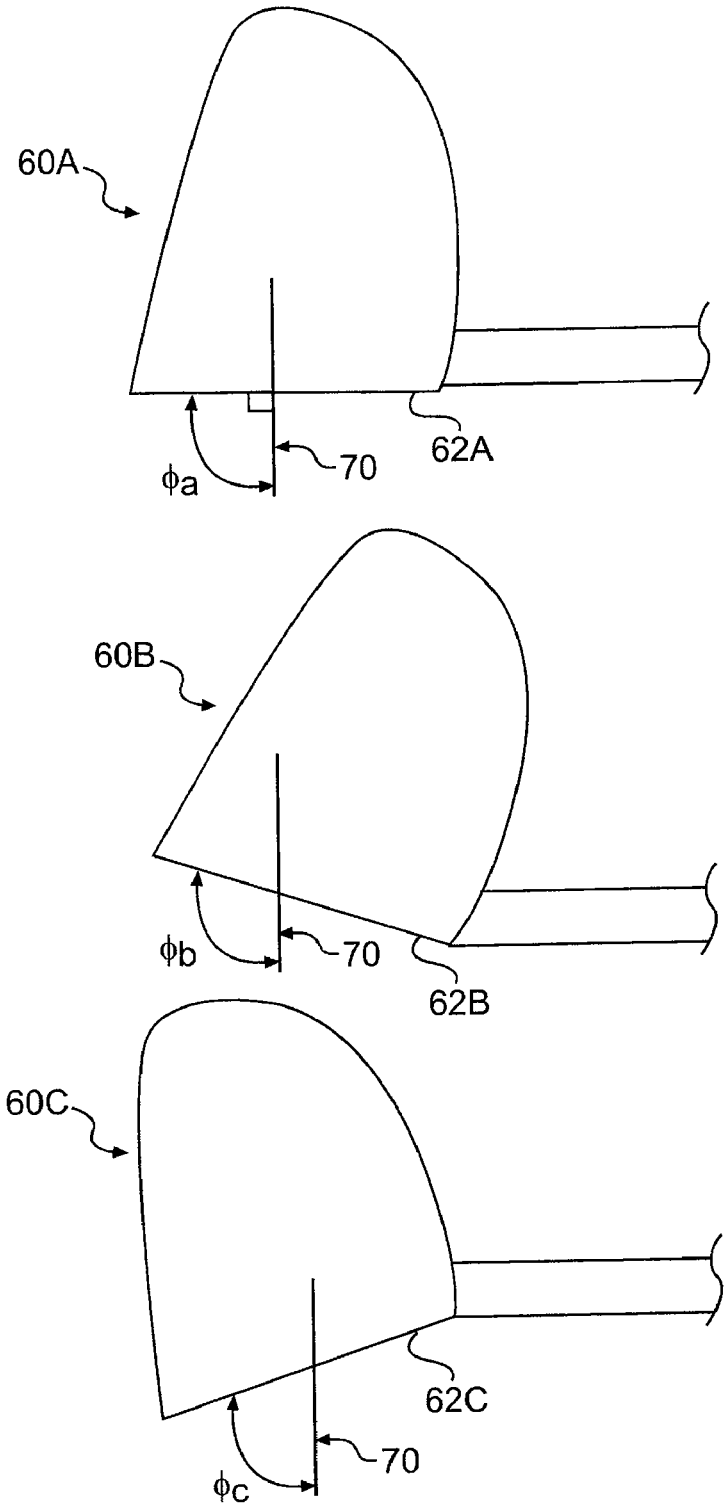
FIG. 10 is a side view of a golf club head showing the adjustability of the loft angle according to the present invention.

FIG. 10, which is a side view of the golf club head of the present invention, shows that, when golf club head 80 is at the address position, loft angle $\theta$ is the angle formed between face 90 and a vertical plane VP perpendicular to the ground plane GP. Thus, the present invention contemplates $\theta$ (the preset loft angle) being between about $\theta$±10°, preferably about $\theta$±5°. For example, a club that is manufactured to have a loft angle of 18° would be adjustable in the range of about 13° to about 23°.

Filler Material

The filler material loaded into the cavity may be a thermoplastic material or other suitable material that is able to be softened or made viscous under certain conditions. For example, to enable the hosel to sit securely within the cavity during normal play conditions, the filler material should be selected so that it is hard and durable at normal golfing conditions, e.g., from about 32° F. to about 130° F. However, to enable the desired adjustability of the hosel within the cavity, the filler material is preferably selected such that, at some point above this temperature range, the material will soften and become malleable to a point that allows movement of the hosel. Thus, a suitable filler material is one that is solid and durable at normal golfing temperatures between about 32° F. and about 120° F., but elastic and flexible at temperatures exceeding about 120° F. to allow for the adjustment of the position of the hosel in the cavity.

For example, any thermoplastic material that has a glass transition temperature $T_g$ about 130° F. or greater would be suitable for use as a hosel filler material. In one embodiment, the filler material has a $T_g$ of about 140° F. or more, preferably about 150° F. or more. In another embodiment, the $T_g$ of the filler material is about 400° F. or less, more preferably about 350° F. or less, and even more preferably about 300° F. or less. In yet another embodiment, the $T_g$ of the filler material ranges from about 130° F. to about 275° F. Thermoplastics with relatively high glass transition temperatures but otherwise desirable properties may be manipulated with a low molecular weight plasticizer or by adding non-reactive side chains to the monomers before polymerization.

As known to those of ordinary skill in the art, most thermoplastic materials are high-molecular-weight polymers whose chains associate through weak Van der Waals forces, such as polyethylene, stronger dipole-dipole interactions and hydrogen bonding, such as nylon, or stacking of aromatic rings, such as polystyrene. Examples of suitable thermoplastics include, but are not limited to: polyurethanes, polyureas, epoxies, elastomers, polyethylene, polyamides, ionomers, polyesters, polypropylene and combinations thereof. Further examples include but are not limited to: polyolefin, polyamide, polytrimethylenc terephthalate, copoly(ether-ester), copoly(ester-ester), copoly(urethane-ester), copoly(urethane-ether), polyacrylate, polystyrene, styrene-butadiene-styrene copolymer, styrene-ethylene-butylene-styrene copolymer, ethylene-propylene-diene terpolymer or ethylene-propylene vulcanized copolymer rubber, polycarbonate, or mixtures thereof.

In one embodiment, the filler material is polyurethane. Thermoplastic polyurethanes are linear or slightly chain branched polymers consisting of hard blocks and soft elastomeric blocks. They are generally produced by reacting soft hydroxy terminated components, such as elastomeric polyethers or polyesters, with diisocyanates, such as methylene diisocyanate ("MDI"), p-phenylene diisocyanate ("PPDI"), or toluene diisocyanate ("TDI"). These polymers can be chain extended with glycols, secondary diamines, diacids, or amino alcohols. The reaction products of the isocyanates and the alcohols are called urethanes, and these blocks are relatively hard and high melting. These hard, high melting blocks are responsible for the thermoplastic nature of the polyurethanes.

In another embodiment, the filler material is polyurea. Polyareas are formed from the reaction of an isocyanate with an amine-terminated compound. The amine-terminated compound may be selected from the group consisting of amine-terminated hydrocarbons, amine-terminated polyethers, amine-terminated polyesters, amine-terminated polycaprolactones, amine-terminated polycarbonates, amine-terminated polyamides, and mixtures thereof.

The specific gravity of the filler material may be less than 1.5. Preferably, the specific gravity of the filler material is less than 1.3, and may be less than 1.0. In addition, the specific gravity of the filler material may be less than the specific gravity of the hosel, and may also be less than the specific gravity of the club head body. In one embodiment, the specific gravity of the filler material In the alternative, high specific gravity additives may be introduced into the filler material. This may serve the purpose of reinforcing the filler material. The high specific gravity additive may increase the specific gravity of the filler material to greater than about 5, or greater than about 7.

In the dual cavity embodiment, the filler material in each cavity 22*a* and 22*b* may the same or different, as discussed in greater detail below. Such a design may allow greater adjustability in one direction versus another. For example, if the filler material in cavity 22*a* becomes viscous at a temperature lower than the required for the filler material in cavity 22*b*, the hosel may be adjustable generally only toward the toe of the club head instead of all directions.

Other than in the operating examples, or unless otherwise expressly specified, all of the numerical ranges, amounts, values, and percentages, such as those for amounts of materials, moments of inertias, center of gravity locations, and others in the following portion of the specification, may be read as if prefaced by the word "about" even though the term "about" may not expressly appear with the value, amount, or range. Accordingly, unless indicated to the contrary, the numerical parameters set forth in the following description and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in any specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

I claim:

1. A golf club head comprising:

a body comprising a face, a crown, a sole, a toe, a heel, a cavity, a hosel, and a shaft, wherein the cavity comprises an outer shell and a filler material, wherein the cavity has a rounded bottom, wherein the filler material has a glass transition temperature, and wherein the hosel is adjustable within the cavity when the filler material reaches the glass transition temperature.

2. The golf club head of claim 1, wherein the filler material is a thermoplastic material.

3. The golf club head of claim 1, wherein the glass transition temperature is about 130° F. or higher.

4. The golf club head of claim 3, wherein the glass transition temperature is about 140° F. or higher.

5. The golf club head of claim 1, wherein the golf club head has a face angle that is adjustable by about 10° or less from a square alignment.

6. The golf club head of claim 1, wherein the golf club head has a lie angle that is adjustable by about 20 percent in either direction.

7. The golf club head of claim 1, wherein the golf club head has a loft angle that is adjustable by about 5° or less from the preset loft angle.

8. The golf club head of claim 1, wherein the filler material comprises polyurethane, polyurea, epoxy, elastomer, polyethylene, polyamides, ionomer, polyesters, polypropylene, or combinations thereof.

9. The golf club head of claim 8, wherein the filler material is selected from the group consisting of polyurethane, polyurea, or a combination thereof.

10. The golf club head of claim 1, wherein the cavity extends less than 75 percent of the distance from the crown to the sole.

11. The golf club head of claim 1, wherein the cavity extends less than about 90 percent of a distance from the crown to the sole.

12. A golf club head comprising:

a body comprising a face, a crown, a sole, a toe, a heel, a hosel disposed within a cavity, and a shaft, wherein the cavity comprises an outer shell with a rounded bottom and a filler material disposed within the outer shell selected from the group consisting of polyurethane, polyurea, or a combination thereof, wherein the filler material has a glass transition temperature of about 130° F. or higher, and wherein the hosel is adjustable within the cavity when the filler material reaches the glass transition temperature.

13. The golf club head of claim 12, wherein the glass transition temperature is about 150° F. or higher.

14. The golf club head of claim 12, wherein the glass transition temperature ranges from about 130° F. to about 275° F.

15. The golf club head of claim 12, wherein the filler material has a specific gravity of less than about 1.5.

16. The golf club head of claim 12, wherein the adjustable hosel allows adjustability of lie angle, face angle, loft angle, or combinations thereof.

17. The golf club head of claim 16, wherein the lie angle is adjustable between about 40° and 70°, the face angle is adjustable by at least about 5° from a square alignment, and the loft angle is adjustable by about 10° or less from a preset loft angle.

18. The golf club head of claim 12, wherein the cavity extends less than about 90 percent of a distance from the crown to the sole.

* * * * *